US011132971B2

(12) United States Patent
Okada

(10) Patent No.: US 11,132,971 B2
(45) Date of Patent: Sep. 28, 2021

(54) VOLTAGE SUPPLY CIRCUIT, LIQUID CRYSTAL DEVICE, ELECTRONIC APPARATUS, AND MOBILE BODY

(71) Applicant: SEIKO EPSON CORPORATION, Tokyo (JP)

(72) Inventor: Shigeru Okada, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/801,339

(22) Filed: Feb. 26, 2020

(65) Prior Publication Data

US 2020/0273423 A1 Aug. 27, 2020

(30) Foreign Application Priority Data

Feb. 27, 2019 (JP) ..... JP2019-034511

(51) Int. Cl.
*G09G 3/36* (2006.01)

(52) U.S. Cl.
CPC ... *G09G 3/3696* (2013.01); *G09G 2310/0289* (2013.01); *G09G 2320/046* (2013.01); *G09G 2380/10* (2013.01)

(58) Field of Classification Search
CPC ..... G09G 2330/021; G09G 2330/028; G09G 1/005; G09G 3/3655
See application file for complete search history.

(56) References Cited

U.S. PATENT DOCUMENTS

2004/0207329 A1* 10/2004 Kudo ..... G06F 1/3203 315/167
2013/0314393 A1* 11/2013 Min ..... G09G 3/3655 345/212
2016/0203746 A1 7/2016 Kim et al.
2017/0278441 A1 9/2017 Ooki et al.
2018/0158406 A1* 6/2018 Kim ..... G09G 3/3233
2019/0073971 A1* 3/2019 Bai ..... G09G 3/3688

FOREIGN PATENT DOCUMENTS

JP 2010-191351 A 9/2010
JP 2017-181574 A 10/2017

* cited by examiner

*Primary Examiner* — Roy P Rabindranath
(74) *Attorney, Agent, or Firm* — Oliff PLC

(57) ABSTRACT

A voltage supply circuit that supplies a voltage to a liquid-crystal panel (10) including a common electrode (30) common to a plurality of pixels is provided with a common voltage generation circuit (310) that generates a common voltage (VCOM) to be supplied to the common electrode 30, an output terminal (320) from which the common voltage (VCOM) is output to the liquid-crystal panel (10), an input terminal (360) to which a voltage of the common electrode (30) detected in the liquid-crystal panel (10) is input as a detection voltage (VCOM_IN), and a first determination circuit (353) that determines whether or not the detection voltage (VCOM_IN) input to the input terminal (360) is normal.

13 Claims, 6 Drawing Sheets

VOLTAGE SUPPLY CIRCUIT, LIQUID CRYSTAL DEVICE, ELECTRONIC APPARATUS, AND MOBILE BODY

The present application is based on, and claims priority from JP Application Serial Number 2019-034511, filed Feb. 27, 2019, the disclosure of which is hereby incorporated by reference herein in its entirety.

BACKGROUND

1. Technical Field

The present disclosure relates to a voltage supply circuit of liquid crystal devices.

2. Related Art

In liquid crystal devices, there are cases where anomalous display occurs as a result of an inadequate voltage being applied to a liquid-crystal panel. Therefore, in a technique described in JP-A-2017-181574, an anomaly in scan signals and data signals, which causes the anomalous display of the liquid-crystal panel, is detected.

However, the anomalous display of the liquid-crystal panel includes anomalous display caused by a burn-in phenomenon, and the burn-in phenomenon occurs as a result of a common voltage applied to a common electrode of the liquid-crystal panel shifting from a normal value. A technique for detecting the occurrence of the burn-in phenomenon caused by such an anomaly in the common voltage has not been provided so far.

SUMMARY

A voltage supply circuit according to one aspect of the disclosure is a voltage supply circuit that supplies a voltage to a liquid-crystal panel including a common electrode common to a plurality of pixels. The voltage supply circuit includes: a common voltage generation circuit configured to generate a common voltage to be supplied to the common electrode; an output terminal from which the common voltage is output to the liquid-crystal panel; an input terminal to which a voltage of the common electrode in the liquid-crystal panel is input as a detection voltage; and a first determination circuit configured to determine whether or not the detection voltage input to the input terminal is normal.

A voltage supply circuit according to another aspect of the disclosure is a voltage supply circuit that supplies a voltage to a liquid-crystal panel including a common electrode common to a plurality of pixels. The voltage supply circuit includes: a common voltage generation circuit configured to generate a common voltage to be supplied to the common electrode; an output terminal from which the common voltage is output to the liquid-crystal panel; and an input terminal to which a voltage of the common electrode in the liquid-crystal panel is input as a detection voltage. The common voltage generation circuit is configured to generate the common voltage based on a result of comparison between a voltage obtained by voltage-dividing the common voltage at a predetermined voltage dividing ratio and a constant voltage. The voltage supply circuit includes: a second reference voltage generation circuit configured to generate a third reference voltage that is higher than the constant voltage by a third voltage and a fourth reference voltage that is lower than the constant voltage by a fourth voltage; a third determination circuit that determines that the detection voltage is normal if a voltage obtained by voltage-dividing the detection voltage input to the input terminal at the predetermined voltage dividing ratio is less than or equal to the third reference voltage and greater than or equal to the fourth reference voltage; a fourth determination circuit that determines that the common voltage is normal if a voltage obtained by voltage-dividing the common voltage at the predetermined voltage dividing ratio is less than or equal to the third reference voltage and greater than or equal to the fourth reference voltage; and a specifying circuit that specifies, if a determination result of the third determination circuit is negative, that an anomaly is present in the liquid-crystal panel if a determination result of the fourth determination circuit is positive, and that an anomaly is present in the common voltage generation circuit if the determination result of the fourth determination circuit is negative.

A voltage supply circuit according to another aspect of the disclosure is a voltage supply circuit that supplies a voltage to a liquid-crystal panel including a common electrode common to a plurality of pixels. The voltage supply circuit includes: a common voltage generation circuit configured to generate a common voltage to be supplied to the common electrode; an output terminal from which the common voltage is output to the liquid-crystal panel; and an input terminal to which a voltage of the common electrode in the liquid-crystal panel is input as a detection voltage. The common voltage generation circuit is configured to generate the common voltage based on a result of comparison between a voltage obtained by voltage-dividing the common voltage at a predetermined voltage dividing ratio and a constant voltage. The voltage supply circuit includes; a second reference voltage generation circuit configured to generate a third reference voltage that is higher than the constant voltage by a third voltage and a fourth reference voltage that is lower than the constant voltage by a fourth voltage; a fifth determination circuit that determines that the liquid-crystal panel is normal if a voltage obtained by voltage-dividing the common voltage at the predetermined voltage dividing ratio is greater than or equal to a first value and less than or equal to a second value of a voltage obtained by voltage-dividing the detection voltage input to the input terminal at the predetermined voltage dividing ratio; a sixth determination circuit that determines that the detection voltage is normal if the voltage obtained by voltage-dividing the detection voltage input to the input terminal at the predetermined voltage dividing ratio is less than or equal to the third reference voltage and greater than or equal to the fourth reference voltage; and a specifying circuit that specifies that an anomaly is present in the liquid-crystal panel if a determination result of the fifth determination circuit is negative, and an anomaly is present in the common voltage generation circuit if the determination result of the fifth determination circuit is positive and a determination result of the sixth determination circuit is negative.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
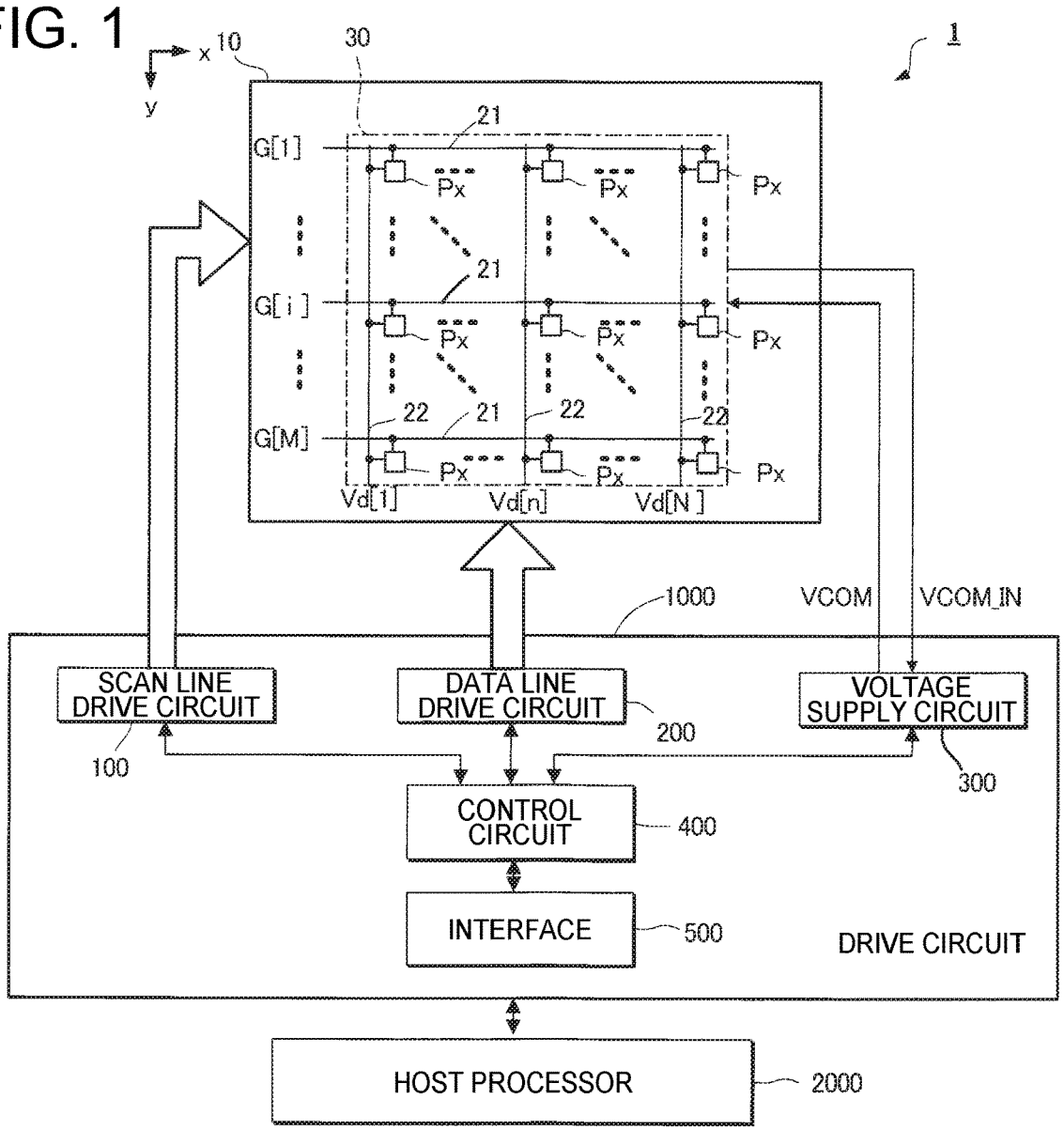
FIG. 1 is a block diagram illustrating a configuration of a liquid crystal device including a voltage supply circuit according to a first embodiment.

Hereinafter, embodiments will be described with reference to the drawings. Note that, in the drawings, the size and scale of each unit are appropriately changed from the actual size and scale thereof. Also, although the following embodiments are limited in various ways so as to be technically preferable, the embodiments are not limited thereto.

A. First Embodiment

FIG. 1 is a block diagram of a liquid crystal device 1 including a voltage supply circuit 300 according to a first embodiment. The liquid crystal device 1 includes a liquid-crystal panel 10, a drive circuit 1000 that drives the liquid-crystal panel 10, and a host processor 2000 that controls the drive circuit 1000.

M scan lines 21 of a first row to an $M^{th}$ row that extend in an x direction and N data lines 22 of a first column to an $N^{th}$ column that extend in a y direction that intersects the x direction are formed in the liquid-crystal panel 10. Note that M and N are natural numbers. In the liquid-crystal panel 10, pixel circuits Px are arranged in a matrix of M rows vertically and N columns horizontally corresponding to the respective intersections of the scan lines 21 and the data lines 22.

As shown in FIG. 1, the drive circuit 1000 includes a scan line drive circuit 100, a data line drive circuit 200, the voltage supply circuit 300, a control circuit 400, and an interface 500.

Input image data Din is supplied from the host processor 2000 to the control circuit 400 via the interface 500 in synchronization with a synchronization signal. Here, the input image data Din is data for defining a tone to be displayed in each pixel circuit Px. For example, the input image data Din may be 8-bit digital data for defining a tone to be displayed in each pixel. Also, the synchronization signal is a signal including a vertical synchronizing signal Vsync, a horizontal synchronizing signal Hsync, and a dot clock signal, for example.

The control circuit 400 generates various types of control signals based on the synchronization signal supplied from the host processor 2000, and controls the scan line drive circuit 100, the data line drive circuit 200, and the voltage supply circuit 300. Also, the control circuit 400 generates display image data indicating the image to be displayed in the liquid-crystal panel 10 based on the input image data Din supplied from the host processor 2000, and outputs the generated display image data to the data line drive circuit 200.

The scan line drive circuit 100 sequentially selects one scan line 21 out of the scan lines 21 of the first to $M^{th}$ rows for each one horizontal scan period H by supplying scan signals G[i] to the respective scan lines 21 of the liquid-crystal panel 10 in synchronization with the horizontal synchronizing signal Hsync. Note that i is a natural number from one to M. Specifically, the scan line drive circuit 100 selects the scan line 21 of the $i^{th}$ row by bringing the scan signal G[i] to an active level.

The data line drive circuit 200 outputs a plurality of driving signals for driving the liquid-crystal panel 10, specifically data signals Vd[n] for driving the N data lines 22, in synchronization with the selection of the scan line 21 by the scan line drive circuit 100. Note that n is a number for designating one of the pixels that are arranged along the x direction, and is a natural number from one to N.

The voltage supply circuit 300 supplies a common voltage VCOM to a common electrode 30 of the liquid-crystal panel 10, and has a function of determining whether or not a detection voltage VCOM_IN is anomalous by obtaining the voltage of the common electrode 30 as the detection voltage VOM_IN. Note that the common electrode 30 will be described later.

Figure 2:
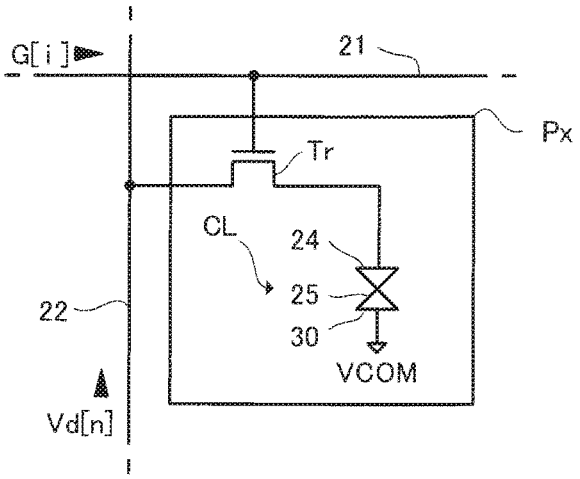
FIG. 2 is a diagram illustrating a configuration of a pixel circuit in the liquid crystal device.

FIG. 2 is a circuit diagram of each pixel circuit Px provided in the liquid-crystal panel 10. As shown in the diagram, each pixel circuit Px includes a liquid crystal element CL and a write transistor Tr. The liquid crystal element CL includes the common electrode 30, a pixel electrode 24, and a liquid crystal 25 provided between the common electrode 30 and the pixel electrode 24. Here, the common electrode 30 is provided so as to oppose the pixel electrodes 24 of all of the pixels in the liquid-crystal panel 10. The common voltage VCOM supplied from the voltage supply circuit 300 is applied to this common electrode 30. The liquid crystal 25 of the liquid crystal element CL changes its transmittance according to the voltage applied to the liquid crystal element CL, more accurately, according to the voltage applied between the common electrode 30 and the pixel electrode 24.

In the present embodiment, the write transistor Tr is an N-channel transistor whose gate is connected to the scan line 21 and that is provided between the liquid crystal element CL and the data line 22 and controls the electrical connection (conductive/non-conductive) therebetween. When the scan signal G[i] is brought to an active level, the write transistors Tr of the respective pixel circuits Px on the $i^{th}$ row transitions to an on state at the same time.

At a timing at which the scan line 21 corresponding to a pixel circuit Px is selected, and the write transistor Tr of the pixel circuit Px is controlled to be in an on state, a data signal Vd[n] is supplied to the pixel circuit Px from the data line 22. As a result, the liquid crystal 25 of the pixel circuit Px is set to have transmittance according to the data signal Vd[n], and the pixel corresponding to the pixel circuit Px displays the tone according to the data signal Vd[n].

Figure 3:
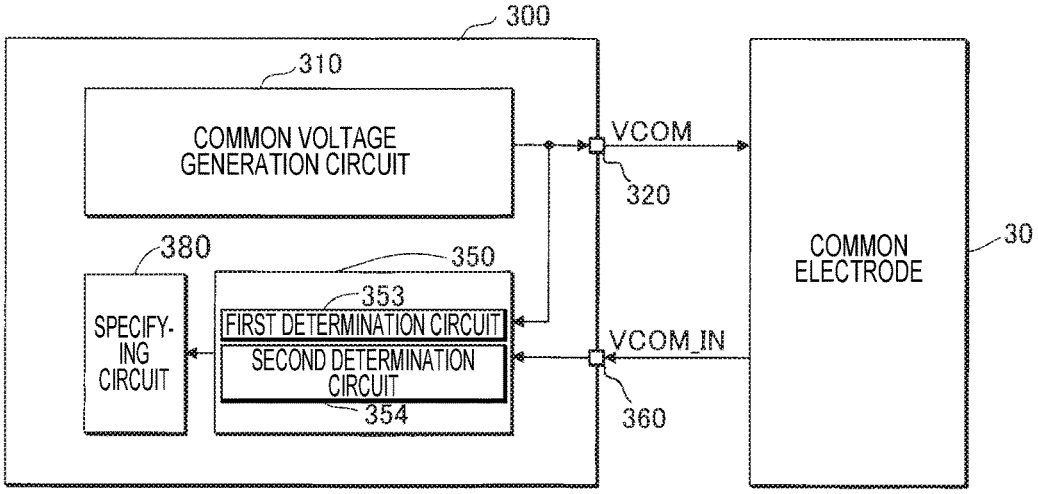
FIG. 3 is a block diagram illustrating a configuration of the voltage supply circuit.

FIG. 3 is a block diagram illustrating a functional configuration of the voltage supply circuit 300. As shown in FIG. 3, the voltage supply circuit 300 includes a common voltage generation circuit 310, a monitoring circuit 350, a specifying circuit 380, an output terminal 320, and an input terminal 360. Here, the output terminal 320 and the input terminal 360 are to be connected to the common electrode 30 of the liquid-crystal panel 10. The common voltage generation circuit 310 supplies the common voltage VCOM to the common electrode 30 from the output terminal 320. The monitoring circuit 350 obtains the voltage of the common electrode 30 through the input terminal 360 as the detection voltage VCOM_IN. The monitoring circuit 350 includes a first determination circuit 353 that determines whether or not the detection voltage VCOM_IN obtained from the common electrode 30 is normal, and a second determination circuit 354 that determines whether or not the common voltage VCOM generated by the common voltage generation circuit 310 is normal. The specifying circuit 380 specifies whether or not there is an anomaly in the common voltage generation circuit 310 and the liquid-crystal panel 10, and the type of the anomaly based on the determination results of the first determination circuit 353 and the second determination circuit 354.

Figure 4:
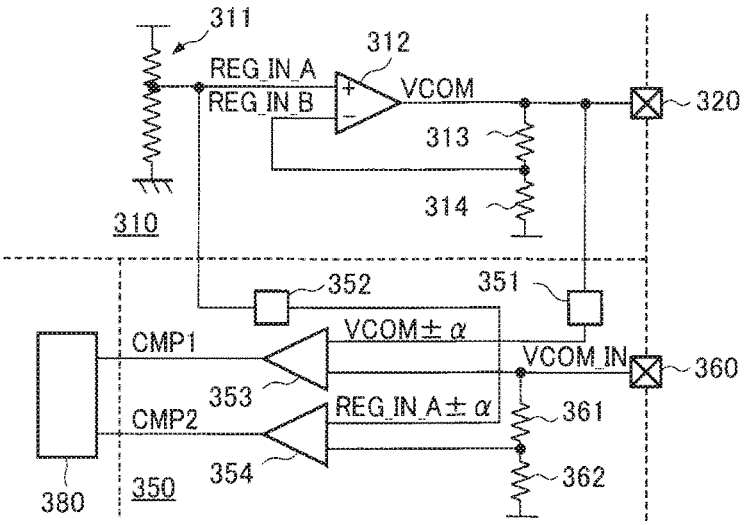
FIG. 4 is a circuit diagram illustrating an exemplary specific configuration of the voltage supply circuit.

FIG. 4 is a circuit diagram illustrating an exemplary specific configuration of the voltage supply circuit 300. In this specific example, the common voltage generation circuit 310 is constituted by a voltage dividing circuit 311 constituted by resistors, an operational amplifier 312, and resistors 313 and 314.

The voltage dividing circuit 311 supplies a voltage REG_IN_A, which is generated by voltage-dividing the voltage between the power supply and ground, to a non-inverting input terminal of the operational amplifier 312.

An output terminal of the operational amplifier 312 is connected to an output terminal 320. The resistors 313 and 314 are connected in series between the output terminal of the operational amplifier 312 and a fixed potential. The common connecting point of the resistors 313 and 314 is connected to an inverting input terminal of the operational amplifier 312.

According to this configuration, a voltage REG_in_B, which is generated by voltage-dividing the output voltage of the operational amplifier 312 by the resistors 313 and 314, is fed back to the inverting input terminal of the operational amplifier 312. Therefore, assume that the resistance value of the resistor 313 is denoted by R1, the resistance value of the resistor 314 is denoted by R2, and ground potential is the fixed potential applied to the resistor 314, for example, the operational amplifier 312 outputs the common voltage VCOM given by the following equation from the output terminal 320.

$$VCOM = REG_IN_A \times (R1+R2)/R2 \quad (1)$$

The monitoring circuit 350 is constituted by a first reference voltage generation circuit 351, a second reference voltage generation circuit 352, a first determination circuit 353, a second determination circuit 354, and resistors 361 and 362.

The resistors 361 and 362 are connected in series between the input terminal 360 and the fixed potential, and constitutes a voltage dividing circuit that voltage-divides the detection voltage VCOM_IN. This voltage dividing circuit is provided for generating a voltage that is obtained by multiplying the detection voltage VCOM_IN by R2/(R1+R2), which is a reciprocal of the ratio (R1+R2)/R2 of the common voltage VCOM relative to the constant voltage REG_IN_A. When the fixed potential applied to the resistor 314 is the same as the fixed potential applied to the resistor 362, the ratio of the resistors 361 and 362 may be the same as the ratio of the resistors 313 and 314.

The first reference voltage generation circuit 351 is a circuit that generates a first reference voltage VCOM+α1 that is higher than the common voltage VCOM by a first voltage α1, and a second reference voltage VCOM-α2 that is lower than the common voltage VCOM by a second voltage α2. The first voltage α1 and the second voltage α2 may be different, or may be the same. In the present embodiment, it is assumed that the first voltage and the second voltage are the same voltage α, and later-described voltages from a third voltage to an eighth voltage are the same voltage α, for the sake of simplification. The first voltage α need only be determined based on the display quality required for the liquid-crystal panel 10, and is usually about 100 mV.

The second reference voltage generation circuit 352 is a circuit that generates a third reference voltage REG_IN_A+α that is higher than the constant voltage REG_IN_A by a third voltage α and a second reference voltage REG_IN_A−α that is lower than the constant voltage REG_IN_A by a fourth voltage α.

Various types of configurations are conceivable as the first reference voltage generation circuit 351 that generates the first reference voltage VCOM+α and the second reference voltage VCOM−α from the common voltage VCOM. The first reference voltage generation circuit 351 may be a level shifter or a known multiplier constituted by an operational amplifier and resistors. Alternatively, the first reference voltage generation circuit 351 may be constituted by a power supply that outputs a voltage α and a voltage −α, an adder that adds the voltage α to the common voltage VCOM, and an adder that adds the voltage −α to the common voltage VCOM. The same applies to the second reference voltage generation circuit 352.

The first determination circuit 353 brings the signal CMP1 to a high level if the detection voltage VCOM_IN is less than or equal to the first reference voltage VCOM +α and is greater than or equal to the second reference voltage VCOM−α, and brings the signal CMP1 to a low level in other cases. Here, the signal CMP1 at a high level indicates that the detection voltage VCOM_IN is normal, and the signal CMP1 at a low level indicates that the detection voltage VCOM_IN is anomalous.

The second determination circuit 354 brings the signal CMP2 to a high level if the voltage VCOM_IN×R2/(R1+R2) obtained by voltage-dividing the detection voltage VCOM_IN by the resistors 361 and 362 is less than or equal to the third reference voltage REG_IN_A+α and is greater than or equal to the fourth reference voltage REG_IN_A−α, and brings the signal CMP2 to a low level in other cases. Here, the signal CMP2 at a high level indicates that the common voltage VCOM is normal, and the signal CMP2 at a low level indicates that the common voltage VCOM is anomalous. The reason why the detection voltage VCOM_IN is used to determine whether or not the common voltage VCOM is normal is that, in a situation in which the liquid-crystal panel 10 is normal, the detection voltage VCOM_IN is substantially the same as the common voltage VCOM.

Figure 5:
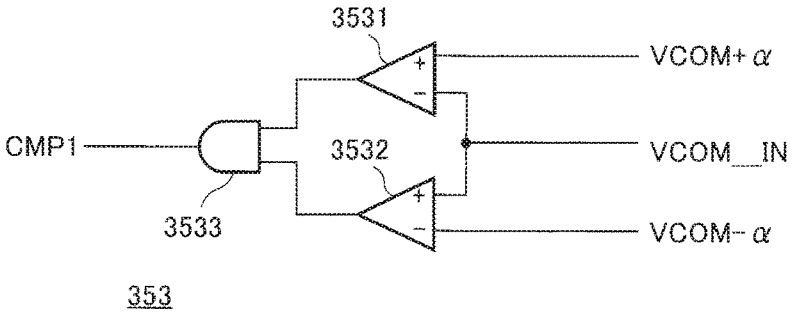
FIG. 5 is a circuit diagram illustrating an exemplary configuration of a determination circuit in the voltage supply circuit.

FIG. 5 is a circuit diagram illustrating an exemplary configuration of the first determination circuit 353. This first determination circuit 353 is a known window comparator that is constituted by two comparators 3531 and 3532 and an AND gate 3533. The second determination circuit 354 also has a similar configuration as the first determination circuit 353.

The specifying circuit 380 specifies whether or not an anomaly is present n the liquid-crystal panel 10, whether or not an anomaly is present in the common voltage generation circuit 310, and the type of the anomaly based on the signal CMP1 indicating a determination result of the first determination circuit 353 and the signal CMP2 indicating a determination result of the second determination circuit 354. Here, the anomaly in the liquid-crystal panel 10 also includes a disconnection of an interconnect that electrically connects the voltage supply circuit 300 and the liquid-crystal panel 10 and short circuits with other interconnects other than an anomaly in the liquid-crystal panel 10 itself.

If the signals CMP1 and CMP2 are both at a high level, that is, if both of the detection voltage VCOM_IN and the common voltage VCOM are normal, the specifying circuit 380 specifies that both of the liquid-crystal panel 10 and the common voltage generation circuit 310 are normal.

If the signal CMP1 is at a low level, that is, if the detection voltage VCOM_IN is anomalous, the specifying circuit 380 specifies that an anomaly is present in the liquid-crystal panel 10. Also, if the signal CMP1 is at a high level and the signal CMP2 is at a low level, that is, if the detection voltage VCOM_IN is normal and the common voltage VCOM is anomalous, the specifying circuit 380 specifies that an anomaly is present in the common voltage generation circuit 310.

The information specified by the specifying circuit 380 is transmitted to the host processor 2000 via the control circuit 400 and the interface 500. In the host processor 2000, the specified information, which is information indicating that an anomaly is present in the liquid-crystal panel 10, for example, is displayed in an unshown display.

As described above, the voltage supply circuit 300 according to the present embodiment includes the common voltage generation circuit 310 that generates the common voltage VCOM to be supplied to the common electrode 30, the output terminal 320 from which the common voltage VCOM is output to the liquid-crystal panel 10, the input terminal 360 to which the voltage of the common electrode 30 in the liquid-crystal panel 10 is input as the detection voltage VCOM_IN, and the first determination circuit 353 that determines whether or not the detection voltage VCOM_IN input to the input terminal 360 is normal.

Therefore, an anomaly in the voltage of the common electrode 30 can be detected. Also, according to the present embodiment, the voltage of the common electrode 30 of the liquid-crystal panel 10 is detected instead of a voltage internal to the drive circuit 1000, and as a result, anomalous display of the liquid-crystal panel 10 can be accurately detected.

Also, in the present embodiment, the first determination circuit 353 determines that it is normal if the detection voltage VCOM_IN is less than or equal to the first reference voltage and is greater than or equal to the second reference voltage. Accordingly, the voltage supply circuit 300 includes the first reference voltage generation circuit 351 that generates the first reference voltage that is higher than the common voltage VCOM by the first voltage $\alpha$ and the second reference voltage that is lower than the common voltage VCOM by the second voltage $\alpha$. Therefore, according to the present embodiment, anomaly in the detection voltage VCOM_IN can be detected with appropriate accuracy. Also, according to the present embodiment, the first reference voltage and the second reference voltage that are to be compared with the detection voltage VCOM_IN change according to the common voltage VCOM, and as a result, an anomaly in the liquid-crystal panel 10 can be detected based on the detection voltage VCOM_IN regardless of whether the common voltage VCOM is normal or anomalous.

Also, according to the present embodiment, since the second determination circuit 354 that determines whether or not the common voltage VCOM is normal is provided, if the determination result of the first determination circuit 353 is negative and the determination result of the second determination circuit 354 is positive, it can be specified that an anomaly is present in the liquid-crystal panel 10, and if the determination result of the second determination circuit 354 is negative, it can be specified that an anomaly is present in the common voltage generation circuit 310.

Also, in the present embodiment, the common voltage generation circuit 310 generates the common voltage VCOM based on the result of comparison between a voltage obtained by voltage-dividing the common voltage VCOM at the predetermined voltage dividing ratio R2/(R1+R2) and the constant voltage REG_IN_A, and the second reference voltage generation circuit 352 generates the third reference voltage REG_IN_A+$\alpha$ that is higher than the constant voltage by the third voltage and the fourth reference voltage REG_IN_A−$\alpha$ that is lower than the constant voltage by the fourth voltage. Therefore, the second determination circuit 354 can determine whether or not the common voltage VCOM is normal by comparing the voltage obtained by voltage-dividing the detection voltage VCOM_IN at the predetermined voltage dividing ratio R2/(R1+R2) with the third reference voltage and the fourth reference voltage.

B. Second Embodiment

Figure 6:
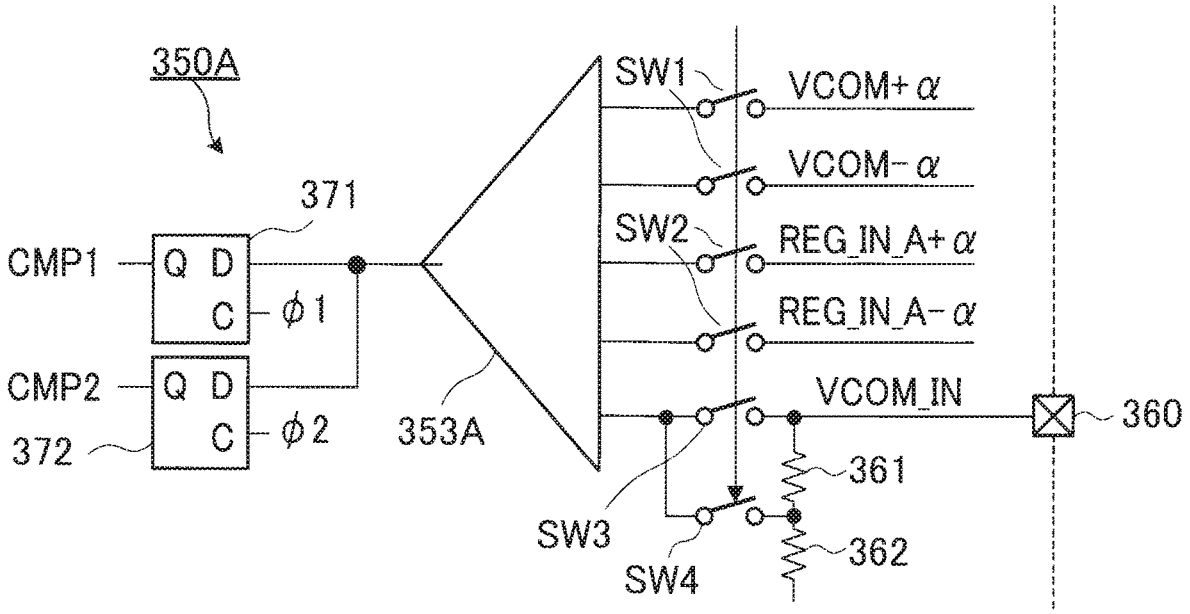
FIG. 6 is a circuit diagram illustrating a configuration of a monitoring circuit in a voltage supply circuit according to a second embodiment.

FIG. 6 is a circuit diagram illustrating a configuration of a monitoring circuit 350A of a voltage supply circuit according to a second embodiment. In the present embodiment, the functions of the first determination circuit 353 and the second determination circuit 354 in the first embodiment are realized by the combination of a first determination circuit 353A and switches. In the monitoring circuit 350A, one end of each of switches SW1 and SW2 is connected to one input terminal of the first determination circuit 353A, and one end of each of switches SW3 and SW4 is connected to the other input terminal. A set of the first reference voltage VCOM+$\alpha$ and the second reference voltage VCOM−$\alpha$ is applied to the other end of the switch SW1. A set of the third reference voltage REG_IN_A+$\alpha$ and the fourth reference voltage REG_IN_A−$\alpha$ is applied to the other end of the switch SW2. The detection voltage VCOM_IN is applied to the other end of the switch SW3. A voltage obtained by voltage-dividing the detection voltage VCOM_IN with resistors 361 and 362 is applied to the other end of the switch SW4.

In the monitoring circuit 350A, the switches SW1 and SW3 are turned on and the switches SW2 and SW4 are turned off in a first period, and the switches SW1 and SW3 are turned off and the switches SW2 and SW4 are turned on in a second period. The first period and the second period are alternatingly repeated.

The switches SW1 and SW2 constitute a first selection circuit to which a set of the first reference voltage and the second reference voltage and a set of the third reference voltage and the fourth reference voltage are input, and that outputs, in the first period, the set of the first reference voltage and the second reference voltage to the first determination circuit 353A, and outputs, in the second period, the set of the third reference voltage and the fourth reference voltage to the first determination circuit 353A.

Also, the switches SW3 and SW4 constitute a second selection circuit to which the detection voltage and a voltage obtained by voltage-dividing the detection voltage at the predetermined voltage dividing ratio are input, and that outputs, in the first period, the detection voltage to the first determination circuit 353A, and outputs, in the second period, the voltage obtained by voltage-dividing the detection voltage at the predetermined voltage dividing ratio to the first determination circuit 353A.

An output terminal of the first determination circuit 353A is connected to data input terminals D of flip-flops 371 and 372. A clock (φ1 is input to a clock input terminal C of the flip-flop 371 in the first period. A clock φ2 is input to a clock input terminal C of the flip-flop 372 in the second period. Also, the flip-flop 371 outputs a signal CMP1, and the flip-flop 372 outputs a signal CMP2.

The first determination circuit 353A and the flip-flops 371 and 372 function as a circuit that outputs the signals CMP1 and CMP2 indicating whether or not the voltage output from the second selection circuit is in a range of the set of reference voltages output from the first selection circuit.

The first determination circuit 353A has a function of the first determination circuit 353 as well as a function of the second determination circuit 354 in the first embodiment. The function of the first determination circuit 353A as the first determination circuit in the first embodiment is to determine that the detection voltage VCOM_IN is normal if the voltage output from the second selection circuit in the first period is in a range of the set of the reference voltages, and the function as the second determination circuit is to determine that the common voltage VCOM is normal if the voltage output from the second selection circuit in the second period is in a range of the set of the reference voltages.

Figure 7:
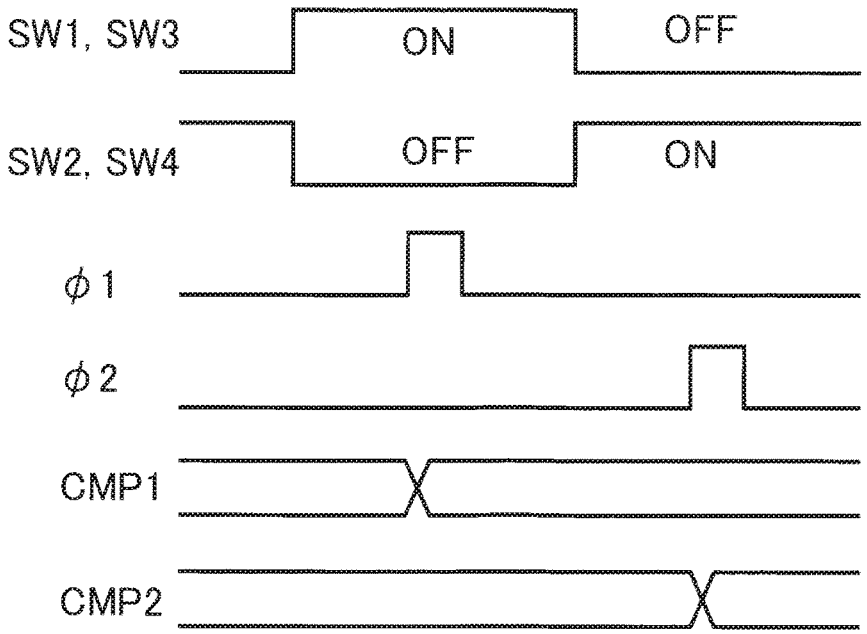
FIG. 7 is a time chart illustrating operations of the monitoring circuit.

FIG. 7 is a time chart illustrating the operations of the present embodiment. Since the switches SW1 and SW3 are turned on and the switches SW2 and SW4 are turned off in the first period, the first determination circuit 353A determines whether or not the detection voltage VCOM_IN is less than or equal to the first reference voltage VCOM+α and greater than or equal to the second reference voltage VCOM−α. This determination result is written into the flip-flop 371 by the clock φ1, and is output as the signal CMP1.

Since the switches SW1 and SW3 are turned off and the switches SW2 and SW4 are turned on in the second period, the first determination circuit 353A determines whether or not the voltage obtained by voltage-dividing the detection voltage VCOM_IN with the resistors 361 and 362 is less than or equal to the third reference voltage REG_IN_A+α and greater than or equal to the fourth reference voltage REG_IN_A−α. This determination result is written into the flip-flop 372 by the clock φ2, and is output as the signal CMP2.

In the present embodiment, such operations are repeated. Therefore, in the present embodiment as well, effects similar to those of the first embodiment can be obtained. Also, in the present embodiment, the determination circuits 353 and 354 in the first embodiment can be shrunk to one determination circuit 353A, and therefore the power consumption can be reduced.

C. Third Embodiment

Figure 8:
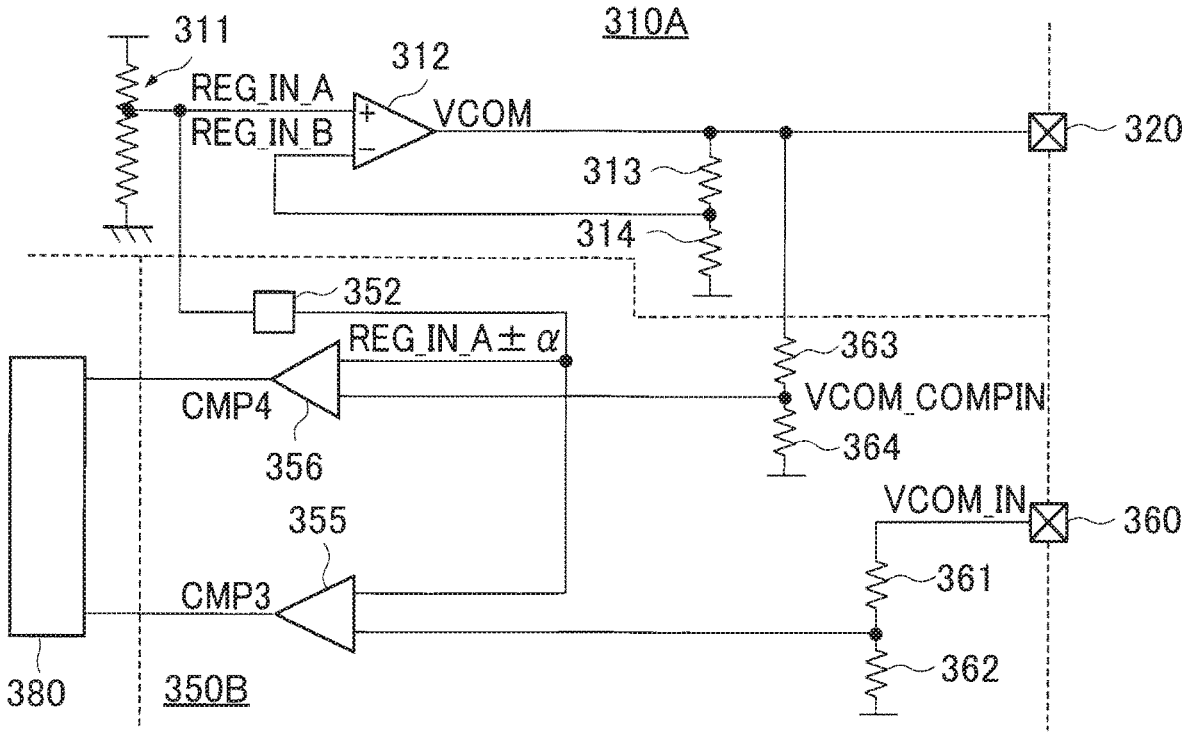
FIG. 8 is a circuit diagram illustrating a configuration of a voltage supply circuit according to a third embodiment.

FIG. 8 is a circuit diagram illustrating a configuration of a voltage supply circuit according to a third embodiment. In the present embodiment, the monitoring circuit 350 in the first embodiment is replaced by a monitoring circuit 350B. In the monitoring circuit 350 of the first embodiment, whether or not the common voltage VCOM generated by the common voltage generation circuit 310 is normal is determined based on the detection voltage VCOM_IN applied to the input terminal 360. In contrast, in the present embodiment, whether or not the common voltage VCOM generated by the common voltage generation circuit 310 is normal is determined based on the common voltage VCOM.

As shown in FIG. 8, in the monitoring circuit 350B, resistors 363 and 364 are connected in series between the output terminal 320 and a fixed potential. The resistor ratio of the resistors 363 and 364 are the same as the resistor ratio of the resistors 313 and 314, and the fixed potential applied to the resistor 364 is the same potential as the fixed potential applied to the resistor 314. In this example, the resistance value of the resistor 363 is denoted by R1, and the resistance value of the resistor 364 is denoted by R2.

Similarly to the first embodiment, a common voltage generation circuit 310A generates the common voltage VCOM based on the result of comparison between a voltage obtained by voltage-dividing the common voltage VCOM at the predetermined voltage dividing ratio R2/(R1+R2) and the constant voltage REG_IN_A. Also, the second reference voltage generation circuit 352 generates the third reference voltage REG_IN_A+α that is higher than the constant voltage by the third voltage and the fourth reference voltage REG_IN_A−α that is lower than the constant voltage by the fourth voltage. Also, a third determination circuit 355 in the present embodiment determines that, if the voltage obtained by voltage-dividing the detection voltage VCOM_IN at the predetermined voltage dividing ratio R2/(R1+R2) is less than or equal to the third reference voltage and greater than or equal to the fourth reference voltage, the detection voltage VCOM_IN is normal, and brings the signal CMP3 to a high level. Also, a fourth determination circuit 356 in the present embodiment determines that, if a voltage VCOM_COMPIN obtained by voltage-dividing the common voltage VCOM at the predetermined voltage dividing ratio R2/(R1+R2) is less than or equal to the third reference voltage and greater than or equal to the fourth reference voltage, the common voltage VCOM is normal, and brings the signal CMP4 to a high level. In the present embodiment as well, effects similar to those of the first embodiment can be obtained.

Note that, in the present embodiment, the voltage VCOM_COMPIN obtained by voltage-dividing the common voltage VCOM with the resistors 363 and 364 is supplied to the fourth determination circuit 356, but the voltage REG_IN_B at the connecting point of the resistors 313 and 314 may be supplied to the fourth determination circuit 356. This mode has an advantage that the resistors 363 and 364 can be omitted.

D. Fourth Embodiment

Figure 9:
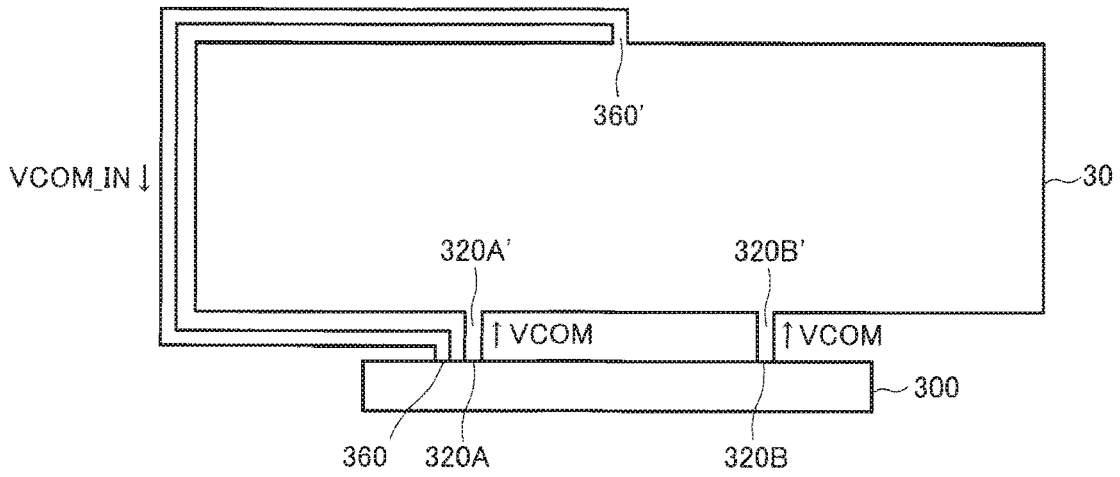
FIG. 9 is a diagram illustrating a configuration of a voltage supply circuit and a common electrode in a fourth embodiment.

FIG. 9 is a diagram illustrating a configuration of the voltage supply circuit 300 and the common electrode 30 in a fourth embodiment. The common electrode 30 has a rectangular shape. The voltage supply circuit 300 includes two output terminals 320A and 320B that are connected to the output terminal of the operational amplifier 312 in FIG. 4, and the input terminal 360 that is connected to input terminals of the first determination circuit 353 and the second determination circuit 354 in FIG. 4.

The common electrode 30 includes first connection portions 320A' and 320B' that are electrically connected to the output terminals 320A and 320B and are arranged on one side of the common electrode 30, and a second connection portion 360' that is electrically connected to the input terminal 360 and is arranged on a side different from the one side of the common electrode 30, specifically on a side opposite to the side on which the first connection portions 320A' and 320B' are arranged.

In the example in FIG. 9, the first connection portions 320A' and 320B' are provided at positions separated from each other on the one side of the common electrode 30. Also, the second connection portion 360' is provided at substantially the center of the side opposite to the one side, that is, at a position most separated from the voltage supply circuit 300 in the common electrode 30.

According to the present embodiment, a voltage at a point at which a worst value of the common voltage is obtained in the common electrode 30 is applied to the input terminal 360 of the voltage supply circuit 300. Therefore, the detection voltage VCOM_IN can be detected under the strictest conditions.

E. Other Embodiments

The first to fourth embodiments have been described above, but other embodiments are also possible. The following is the other embodiments, for example.

(1) In the first embodiment, the detection voltage VCOM_IN is compared with the first reference voltage and the second reference voltage that are generated from the common voltage VCOM, but the detection voltage VCOM_IN may be compared with a first reference voltage and a second reference voltage that are generated by a voltage source, for example.

(2) In the first embodiment, the first determination circuit 353 determines that the detection voltage VCOM_IN is normal if the detection voltage VCOM_IN is less than or equal to the first reference voltage and greater than or equal to the second reference voltage. Instead of that, a simple determination method may be implemented in which it is determined that the detection voltage VCOM_IN is normal if the detection voltage VCOM_IN is less than or equal to a fifth reference voltage, or if the detection voltage VCOM_IN is greater than or equal to a sixth reference voltage, for example. This mode has an advantage that the configuration for determination can be simplified.

In this mode, when the common voltage generation circuit 310 generates the common voltage VCOM based on a result of comparison between a voltage obtained by voltage-dividing the common voltage VCOM at a predetermined voltage dividing ratio and a constant voltage, the second determination circuit 354 may determine that the common voltage is normal if the voltage obtained by voltage-dividing the detection voltage VCOM_IN at the predetermined voltage dividing ratio is less than or equal to a seventh reference voltage or greater than or equal to an eighth reference voltage.

The functions of the specifying circuit 380 for specifying whether or not an anomaly is present and the type of the anomaly from determination results of the first determination circuit 353 and the second determination circuit 354 are similar to those of the first embodiment.

Alternatively, the second determination circuit 354 may determine whether or not the common voltage is normal using a voltage obtained by voltage-dividing the common voltage VCOM at the predetermined voltage dividing ratio instead of the voltage obtained by voltage-dividing the detection voltage VCOM_IN at the predetermined voltage dividing ratio.

(3) A voltage supply circuit in which a common voltage generation circuit generates the common voltage VCOM based on a result of comparison between a voltage obtained by voltage-dividing the common voltage VCOM at the predetermined voltage dividing ratio R2/(R1+R2) and the constant voltage REG_IN_A may be provided with a second reference voltage generation circuit, a fifth determination circuit, a sixth determination circuit, and a specifying circuit, which will be described below.

The second reference voltage generation circuit generates a third reference voltage REG_IN_A+α that is higher than the constant voltage by a third voltage and a fourth reference voltage REG_IN_A−α that is lower than the constant voltage by a fourth voltage. The fifth determination circuit determines that the liquid-crystal panel 10 is normal if the voltage obtained by voltage-dividing the common voltage VCOM at the predetermined voltage dividing ratio R2/(R1+R2) is greater than or equal to a first value and less than or equal to a second value of the voltage obtained by voltage-dividing the detection voltage VCOM_IN input to the input terminal 360 at the predetermined voltage dividing ratio R2/(R1+R2). The sixth determination circuit determines that the detection voltage VCOM_IN is normal if the voltage obtained by voltage-dividing the detection voltage VCOM_IN input to the input terminal 360 at the predetermined voltage dividing ratio R2/(R1+R2) is less than or equal to the third reference voltage and greater than or equal to the fourth reference voltage. The specifying circuit specifies that an anomaly is present in the liquid-crystal panel 10 if the determination result of the fifth determination circuit is negative, and specifies that an anomaly is present in the common voltage generation circuit 310 if the determination result of the fifth determination circuit is positive and the determination result of the sixth determination circuit is negative.

The functions of the fifth determination circuit can be realized by the following configuration, for example. In the configuration in FIG. 8 described above, a reference voltage REG_IN_B+α and a reference voltage REG_IN_B−α are generated based on the voltage REG_IN_B obtained by voltage-dividing the common voltage VCOM at the predetermined voltage dividing ratio R2/(R1+R2). The fifth determination circuit determines that the liquid-crystal panel 10 is normal if the voltage obtained by voltage-dividing the detection voltage VCOM_IN input to the input terminal 360 at the predetermined voltage dividing ratio R2/(R1+R2) is in a range from the reference voltage REG_IN_B+α to the reference voltage REG_IN_B−α. It is because that if the voltage obtained by voltage-dividing the detection voltage VCOM_IN input to the input terminal 360 at the predetermined voltage dividing ratio R2/(R1+R2) is in a range from the reference voltage REG_IN_B+α to the reference voltage REG_IN_B−α, the voltage obtained by voltage-dividing the common voltage VCOM at the predetermined voltage dividing ratio R2/(R1+R2) is greater than or equal to the first value and less than or equal to the second value of the voltage obtained by voltage-dividing the detection voltage VCOM_IN at the predetermined voltage dividing ratio R2/(R1+R2). Note that the first value and the second value are values determined using a described above. In this mode as well, effects similar to those of the embodiments described above can be obtained.

F. Application Examples

The liquid crystal device 1 illustrated in the above modes can be used in various types of electronic apparatuses. FIGS.

7 to 10 illustrate specific modes of electronic apparatuses that have adopted the liquid crystal device 1.

Figure 10:
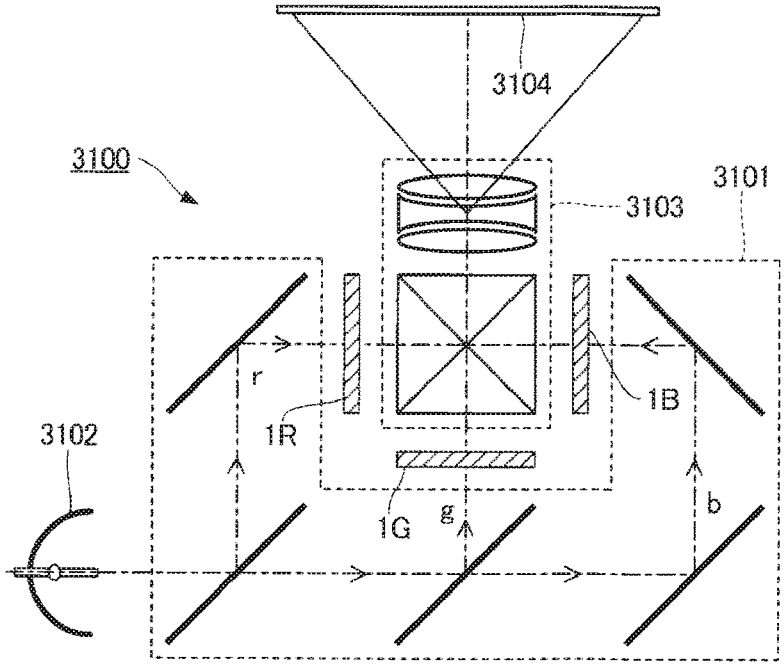
FIG. 10 is a schematic diagram of a projection type display device, which is an application example.

FIG. 10 is a schematic diagram of a projection type display device 3100 to which liquid crystal devices 1R, 1G, and 1B each having a similar configuration as the liquid crystal device 1 are applied. The projection type display device 3100 includes the three liquid crystal devices 1R, 1G, and 1B corresponding to different display colors, specifically red, green, and blue. A lighting optical system 3101 supplies, of emitted light from a lighting device 3102, a red component r to the liquid crystal device 1R, a green component g to the liquid crystal device 1G, and a blue component b to the liquid crystal device 1B. Each liquid crystal device 1 functions as an optical modulator that modulates monochromatic light supplied from the lighting optical system 3101 according to a display image. The projection optical system 3103 combines the beams of emitting light from the respective liquid crystal device 1, and projects the combined light on a projection plane 3104. An observer views the image projected on the projection plane 3104.

Figure 11:
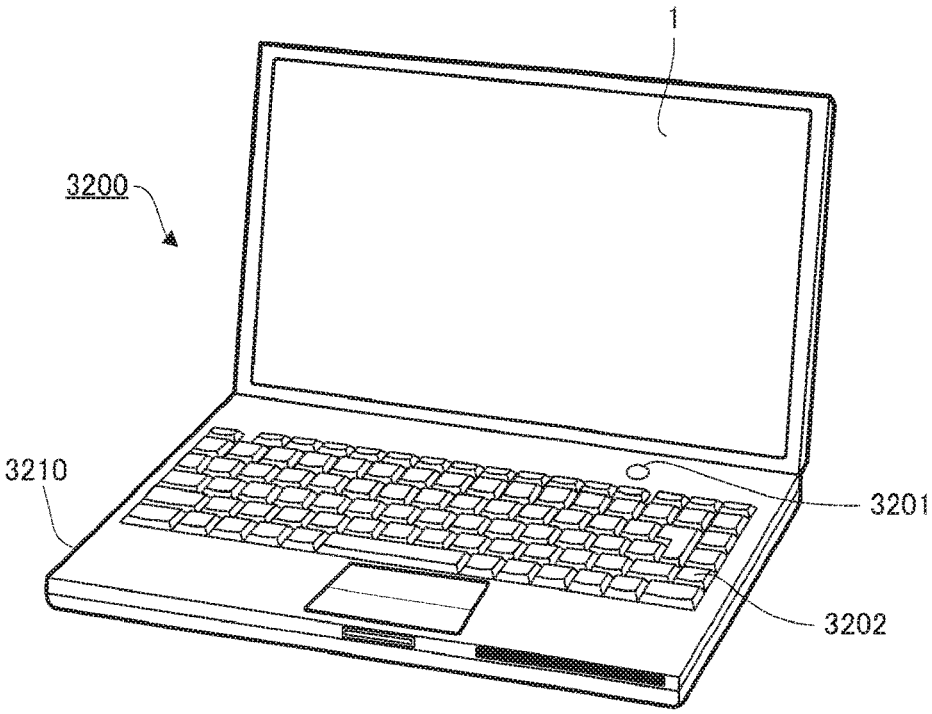
FIG. 11 is a schematic diagram of a personal computer, which is an application example.

FIG. 11 is a perspective view of a portable personal computer 3200 that has adopted the liquid crystal device 1. The personal computer 3200 includes the liquid crystal device 1 that displays various types of images and a body portion 3210 in which a power switch 3201 and a keyboard 3202 are provided.

Figure 12:
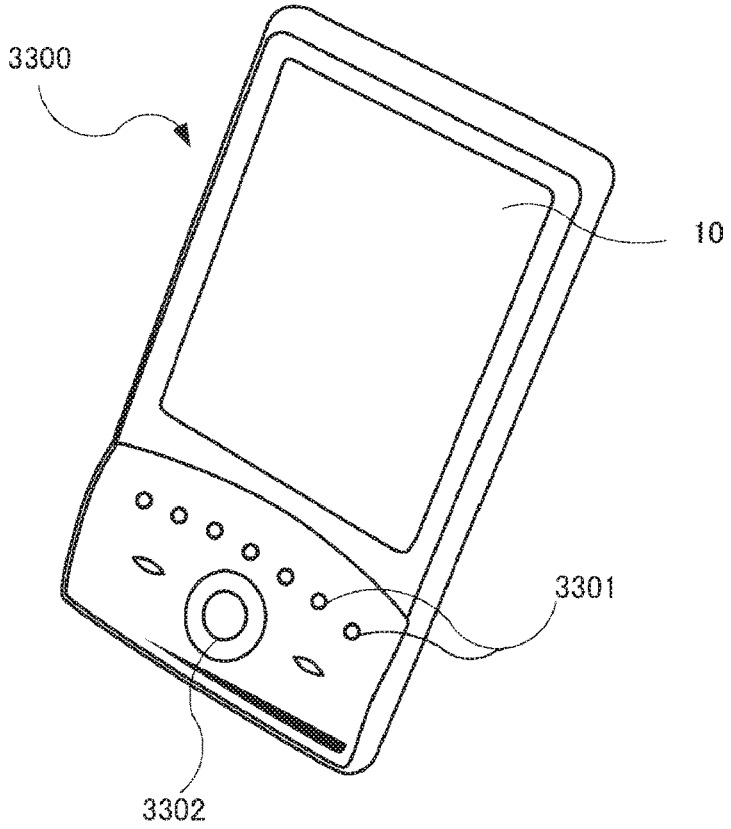
FIG. 12 is a schematic diagram of a mobile phone, which is an application example.

FIG. 12 is a diagram illustrating an exemplary configuration of an information mobile terminal (PDA: Personal Digital Assistants) to which the liquid crystal device 1 has been applied. The information mobile terminal 3300 includes a plurality of operation buttons 3301, a power switch 3302, and the liquid crystal device 1 serving as a display unit. When the power switch 3302 is operated, various types of information such as an address book and a schedule book are displayed in the liquid crystal device 1.

The electronic apparatuses to which the liquid crystal device 1 is applied include, other than the apparatuses illustrated in FIGS. 10 to 12, a mobile information terminal (PDA: Personal Digital Assistants), a digital still camera, a television, a video camera, an electronic organizer, electronic paper, an electronic calculator, a word processor, a workstation, a video telephone, a POS terminal, a printer, a scanner, a copier, a video player, an apparatus including a touch panel, and the like.

Figure 13:
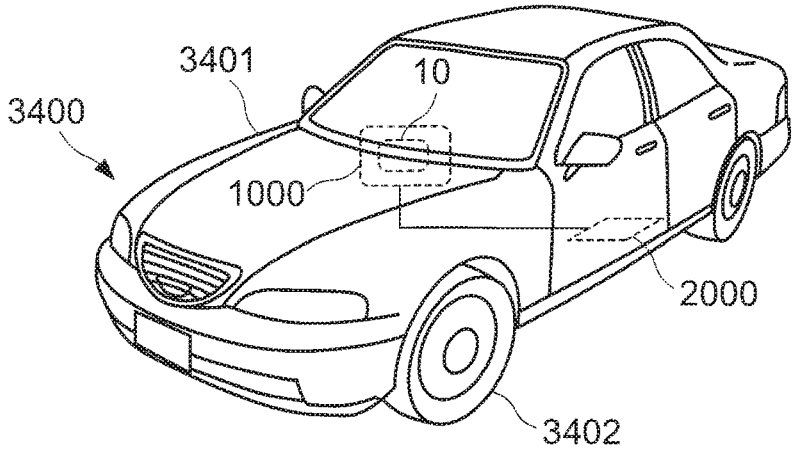
FIG. 13 is a schematic diagram of a mobile body, which is an application example.

FIG. 13 illustrates an exemplary configuration of a mobile body to which the liquid crystal device 1 has been applied. The mobile body is an apparatus or a device that includes a drive mechanism such as an engine or a motor, steering mechanisms such as a steering wheel or a rudder, and various electronic apparatuses, for example, and moves on the ground, in the air, and on the sea. A car, an airplane, a motorcycle, a ship, a robot, or the like can be envisioned as the mobile body. FIG. 13 schematically illustrates an automobile 3400 serving as a specific example of the mobile body. The automobile 3400 includes a car body 3401 and wheels 3402. The liquid-crystal panel 10, the drive circuit 1000, and the host processor 2000 that controls the units of the automobile 3400 are incorporated in the automobile 3400. The host processor 2000 can include an ECU or the like. The liquid-crystal panel 10 is a panel apparatus such as a meter panel. The host processor 2000 generates an image for presenting to a user, and transmits the image to the drive circuit 1000. The drive circuit 1000 displays the received image in the liquid-crystal panel 10. For example, pieces of information such as speed, a remaining fuel amount, a travel distance, and settings of various devices are displayed as an image.

What is claimed is:

1. A voltage supply circuit that supplies a voltage to a liquid-crystal panel including a common electrode common to a plurality of pixels, the voltage supply circuit comprising:

a common voltage generation circuit configured to generate a common voltage to be supplied to the common electrode;

an output terminal from which the common voltage is output to the liquid-crystal panel;

an input terminal to which a voltage of the common electrode in the liquid-crystal panel is input as a detection voltage;

a first determination circuit configured to determine whether or not the detection voltage input to the input terminal is normal;

a specifying circuit that specifies that an anomaly is present in the liquid-crystal panel based on a determination result of the first determination circuit, and a type of the anomaly among a plurality of types of anomalies; and a second determination circuit that determines whether or not the common voltage is normal, wherein the specifying circuit specifies that the anomaly is present in the liquid-crystal panel if the determination result of the first determination circuit is negative, and the anomaly is present in the common voltage generation circuit if the determination result of the first determination circuit is positive and a determination result of the second determination circuit is negative.

2. The voltage supply circuit according to claim 1, wherein the first determination circuit determines that the detection voltage is normal if the detection voltage is less than or equal to a first reference voltage and greater than or equal to a second reference voltage.

3. The voltage supply circuit according to claim 2, further comprising a first reference voltage generation circuit configured to generate the first reference voltage that is higher than the common voltage by a first voltage and the second reference voltage that is lower than the common voltage by a second voltage.

4. The voltage supply circuit according to claim 1, wherein the common voltage generation circuit is configured to generate the common voltage based on a result of comparison between a voltage obtained by voltage-dividing the common voltage at a predetermined voltage dividing ratio and a constant voltage, the voltage supply circuit includes a second reference voltage generation circuit that generates a third reference voltage that is higher than the constant voltage by a third voltage and a fourth reference voltage that is lower than the constant voltage by a fourth voltage; and the second determination circuit determines that the common voltage is normal if a voltage obtained by voltage-dividing the detection voltage at the predetermined voltage dividing ratio is less than or equal to the third reference voltage and greater than or equal to the fourth reference voltage.

5. The voltage supply circuit according to claim 1, wherein the first determination circuit determines that the detection voltage is normal if the detection voltage is less than or equal to a fifth reference voltage or greater than or equal to a sixth reference voltage.

6. The voltage supply circuit according to claim 5, wherein the common voltage generation circuit is configured to generate the common voltage based on a result of comparison between a voltage obtained by voltage-dividing the common voltage at a predetermined voltage dividing ratio and a constant voltage, the voltage supply circuit includes a second determination circuit that determines that the common voltage is normal if a voltage obtained by voltage-dividing the detection voltage at the predetermined voltage dividing ratio is less than or equal to a seventh reference voltage or greater than or equal to an eighth reference voltage, and the specifying circuit specifies that the anomaly is present in the liquid-crystal panel if the determination result of the first determination circuit is negative, and specifies that the anomaly is present in the common voltage generation circuit if the determination result of the first determination circuit is positive and a determination result of the second determination circuit is negative.

7. The voltage supply circuit according to claim 5, wherein the common voltage generation circuit is configured to generate the common voltage based on a result of comparison between a voltage obtained by voltage-dividing the common voltage at a predetermined voltage dividing ratio and a constant voltage, the voltage supply circuit includes a second determination circuit that determines that the common voltage is normal if a voltage obtained by voltage-dividing the common voltage at the predetermined voltage dividing ratio is less than or equal to a seventh reference voltage or greater than or equal to an eighth reference voltage, and wherein the specifying circuit specifies that the anomaly is present in the liquid-crystal panel if the determination result of the first determination circuit is negative and a determination result of the second determination circuit is positive, and specifies that the anomaly is present in the common voltage generation circuit if the determination result of the second determination circuit is negative.

8. A liquid crystal device comprising:

the voltage supply circuit according to claim 1; and a liquid-crystal panel including a common electrode common to a plurality of pixels.

9. The liquid crystal device according to claim 8, wherein the common electrode includes:

a first connection portion that is electrically connected to the output terminal and is arranged on one side of the common electrode, and a second connection portion that is electrically connected to the input terminal and is arranged on a side different from the one side of the common electrode.

10. An electronic apparatus comprising the liquid crystal device according to claim 8.

11. A mobile body comprising the electronic apparatus according to claim 10.

12. A voltage supply circuit that supplies a voltage to a liquid-crystal panel including a common electrode common to a plurality of pixels, the voltage supply circuit comprising:

a common voltage generation circuit configured to generate a common voltage to be supplied to the common electrode;

an output terminal from which the common voltage is output to the liquid-crystal panel; and an input terminal to which a voltage of the common electrode in the liquid-crystal panel is input as a detection voltage, wherein the common voltage generation circuit is configured to generate the common voltage based on a result of comparison between a voltage obtained by voltage-dividing the common voltage at a predetermined voltage dividing ratio and a constant voltage, and the voltage supply circuit includes:

a second reference voltage generation circuit configured to generate a third reference voltage that is higher than the constant voltage by a third voltage and a fourth reference voltage that is lower than the constant voltage by a fourth voltage;

a third determination circuit that determines that the detection voltage is normal if a voltage obtained by voltage-dividing the detection voltage input to the input terminal at the predetermined voltage dividing ratio is less than or equal to the third reference voltage and greater than or equal to the fourth reference voltage;

a fourth determination circuit that determines that the common voltage is normal if a voltage obtained by voltage-dividing the common voltage at the predetermined voltage dividing ratio is less than or equal to the third reference voltage and greater than or equal to the fourth reference voltage; and a specifying circuit that specifies that an anomaly is present in the liquid-crystal panel if a determination result of the third determination circuit is negative and a determination result of the fourth determination circuit is positive, and specifies that the anomaly is present in the common voltage generation circuit if the determination result of the fourth determination circuit is negative.

13. A voltage supply circuit that supplies a voltage to a liquid-crystal panel including a common electrode common to a plurality of pixels, the voltage supply circuit comprising:

a common voltage generation circuit configured to generate a common voltage to be supplied to the common electrode;

an output terminal from which the common voltage is output to the liquid-crystal panel;

an input terminal to which a voltage of the common electrode in the liquid-crystal panel is input as a detection voltage;

a first determination circuit configured to determine whether or not the detection voltage input to the input terminal is normal; and a specifying circuit that specifies that an anomaly is present in the liquid-crystal panel based on a determination result of the first determination circuit, and a type of the anomaly among a plurality of types of anomalies;

a second reference voltage generation circuit configured to generate a third reference voltage that is higher than a constant voltage by a third voltage and a fourth reference voltage that is lower than the constant voltage by a fourth voltage;

a first selection circuit to which a first set of a first reference voltage and a second reference voltage and a second set of the third reference voltage and the fourth reference voltage are input, and that is configured to output the first set to the first determination circuit in a first period and output the second set to the first determination circuit in a second period; and a second selection circuit to which the detection voltage and a voltage obtained by voltage-dividing the detection voltage at a predetermined voltage dividing ratio are input, and that is configured to output the detection voltage to the first determination circuit in the first period, and output the voltage obtained by voltage-dividing the detection voltage at the predetermined voltage dividing ratio to the first determination circuit in the second period, wherein the first determination circuit determines that the detection voltage is normal if the detection voltage output from the second selection circuit in the first period is in a range of the first set of the first reference voltage and the second reference voltage, and determines that the common voltage is normal if the voltage obtained by voltage-dividing the detection voltage at the predetermined voltage dividing ratio that is output from the second selection circuit in the second period is in a range of the second set of the reference voltages.

* * * * *